US008746297B2

(12) United States Patent
Liu et al.

(10) Patent No.: US 8,746,297 B2
(45) Date of Patent: Jun. 10, 2014

(54) POSITIONING DEVICE FOR PRODUCTION LINE OF LARGE AND SOFT INFUSION BAG

(75) Inventors: Zhen Liu, Changsha (CN); Bo Yang, Changsha (CN); Benhong Huo, Changsha (CN); Pengcheng Li, Changsha (CN); Yue Tang, Changsha (CN)

(73) Assignee: Truking Technology Limited, Changsha, Hunan (CN)

( * ) Notice: Subject to any disclaimer, the term of this patent is extended or adjusted under 35 U.S.C. 154(b) by 245 days.

(21) Appl. No.: 13/418,413

(22) Filed: Mar. 13, 2012

(65) Prior Publication Data

US 2012/0168573 A1 Jul. 5, 2012

(51) Int. Cl.
*B65B 43/46* (2006.01)

(52) U.S. Cl.
USPC ..... 141/114; 141/314

(58) Field of Classification Search
USPC ..... 141/10, 114, 313–317
See application file for complete search history.

(56) References Cited

U.S. PATENT DOCUMENTS

| | | | | |
|---|---|---|---|---|
| 4,201,031 | A * | 5/1980 | Wiles | 53/455 |
| 5,870,880 | A * | 2/1999 | Romagnoli | 53/134.2 |
| 7,188,458 | B2 * | 3/2007 | Rea et al. | 53/134.2 |
| 7,610,115 | B2 * | 10/2009 | Rob et al. | 700/245 |
| 8,151,835 | B2 * | 4/2012 | Khan et al. | 141/114 |
| 8,539,989 | B2 * | 9/2013 | Giribona et al. | 141/91 |
| 2002/0139086 | A1 * | 10/2002 | Ghirlandi | 53/413 |

* cited by examiner

*Primary Examiner* — Gregory Huson
*Assistant Examiner* — Nicolas A Arnett
(74) *Attorney, Agent, or Firm* — Raymond Y. Chan; David and Raymond Patent Firm

(57) ABSTRACT

A positioning device for a production line of a large and soft infusion bag comprises a driving cylinder (4) and a locating fork (5). The telescoping end of the driving cylinder (4) is connected to one end of the locating fork (5), and the other end of the locating fork (5) is fixed between a soft bag connector nip (2) on the large and soft transfusion bag production line and a filing mouth (1). A stress plate (51) is fixed below the locating fork (5), and located below the soft bag connector nip (2). The device has a simple and compact structure, is inexpensive and reliable to use, and can effectively protect pins, so as to prolong the service life of the pins.

8 Claims, 2 Drawing Sheets

POSITIONING DEVICE FOR PRODUCTION LINE OF LARGE AND SOFT INFUSION BAG

BACKGROUND OF THE PRESENT INVENTION

1. Field of Invention

The present invention relates to a machinery for packaging which is used in pharmaceutical industries, and more particularly to a locating device used in a production line for filling liquid into large and soft infusion bag.

2. Description of Related Arts

In a large and soft infusion bag production line, after the bag is manufactured, a liquid form medication is then filled into the bag. While filling, it is required that the filling mouth and the opening of the bag are sealed so as to prevent the liquid form medication from leaking through the opening. When the filling mouth and the opening are sealed, a certain pressure is applied on the filling mouth in order to achieve the sealing of the filling mouth and the opening of the bag in a reliable manner. In a general production line of large and soft infusion bag, such as the turnable mechanical arm for magnetic soft bag manufacture in Chinese patent number 20082021167.2, and the positioning clip for automated production line of non-PVC film bag in Chinese patent number 200620050712.5, the connecting clip of the soft bag usually requires a turning pin for rotation at 90° C. so as to ensure that the connecting clip of the soft bag is maintained at a vertical position during bag manufacture and at a horizontal position during filling liquid form medication. Because the filling mouth has certain pressure exerted onto the connecting part of the soft bag and the connecting part of the soft bag is clipped onto the connecting clip of the soft bag, when filling, the need of sealing leads to the pressure of the filling mouth which is exerted on the connecting part of the soft bag being transmitted to the connecting clip of the soft bag while a great proportion of force of the connecting clip of the soft bag is transmitted to the turning pin. Since the of the connecting clip of the soft bag is transmitted to the turning pin. Since the construction of pin structure has a size limitation and its size cannot be very large, strength of the turning pin is relatively low and therefore may pose a hidden concern to the production line of infusion bag. When filling, the force acted on the turning pin will damage the turning pin. After a certain period of time, the turning pin cannot be used because of excessive wear and tear, thereby adversely affecting the normal operation of the production line of the large and soft infusion bag and causing damages to the user.

SUMMARY OF THE PRESENT INVENTION

Accordingly, the present invention is to solve the technical problem existed in the conventional technology. The present invention provides a positioning device for large and soft infusion bag production line which is simple and compact in size, low in cost and reliable while having features to protect a turning pin so as to prolong the life span of the turning pin.

Additional advantages and features of the invention will become apparent from the description which follows, and may be realized by means of the instrumentalities and combinations particular point out in the appended claims.

According to the present invention, the foregoing and other objects and advantages are attained by the followings:

A positioning device for a production line of a large and soft infusion bag which includes a driving cylinder, a positioning fork having a first and a second ends and a soft bag connecting clip, wherein the driving cylinder has a retractable end connected to the first end of the positioning fork, wherein the second end of the positioning fork is positioned between the connecting clip and a filling mouth of the infusion bag, the position device characterized in that: the positioning fork has a lower portion and comprises a stress plate at the lower portion of the positioning fork, wherein the stress plate is positioned below the connecting clip.

The present invention is further improved with the following features:

The stress plate and the positioning fork are integrally connected.

The stress plate has a bottom and is mounted onto a frame body of the production line through a support element and the bottom of the stress plate.

The stress plate has an upper surface which is fittingly connected to a bottom surface of the connecting clip. The stress plate has an upper surface and a bottom surface, wherein the upper surface of the stress plate is fittingly connected to a bottom surface of the connecting clip, and the bottom surface of the stress plate is fittingly connected to an upper surface of the support element.

Compared to conventional technologies, the advantageous effect of the present invention is as follows:

According to the preferred embodiment of the present invention, a bottom of the positioning fork includes a stress plate. During filling process, the stress plate is pushed to have movement by the driving cylinder. The stress plate has a right side end which is fittingly connected to the soft bag connecting clip and defining a connecting portion between the stress plate and the soft bag connecting clip. The connecting portion is aligned at a position adjacent to a central axis of a soft bag connecting element of the soft bag. Through the provision of the stress plate, a large portion of pressure which is acted onto the turning pin by the filling mouth of the soft bag is directed to the support element such that the force exerted on the turning pin is eliminated or greatly reduced, thereby achieving the object of protecting the turning pin and prolong the lifespan of the turning pin.

Still further objects and advantages will become apparent from a consideration of the ensuing description and drawings.

These and other objectives, features, and advantages of the present invention will become apparent from the following detailed description, the accompanying drawings, and the appended claims.

DESCRIPTION OF NUMERICAL REFERENCES

1: Filling mouth; 2: soft bag connecting clip; 3: filling mouth lifting device; 4: driving cylinder; 5: positioning fork; 6: support element; 7: turning pin; 8: soft bag; 9: soft bag connecting clip base; 10: soft bag connecting clip sliding plate; 11: soft bag connecting element; 12: frame body; 51: stress plate.

DETAILED DESCRIPTION OF THE PREFERRED EMBODIMENT

The present invention is further described with the accompanying drawings and illustrative examples as follows.

Figure 1:
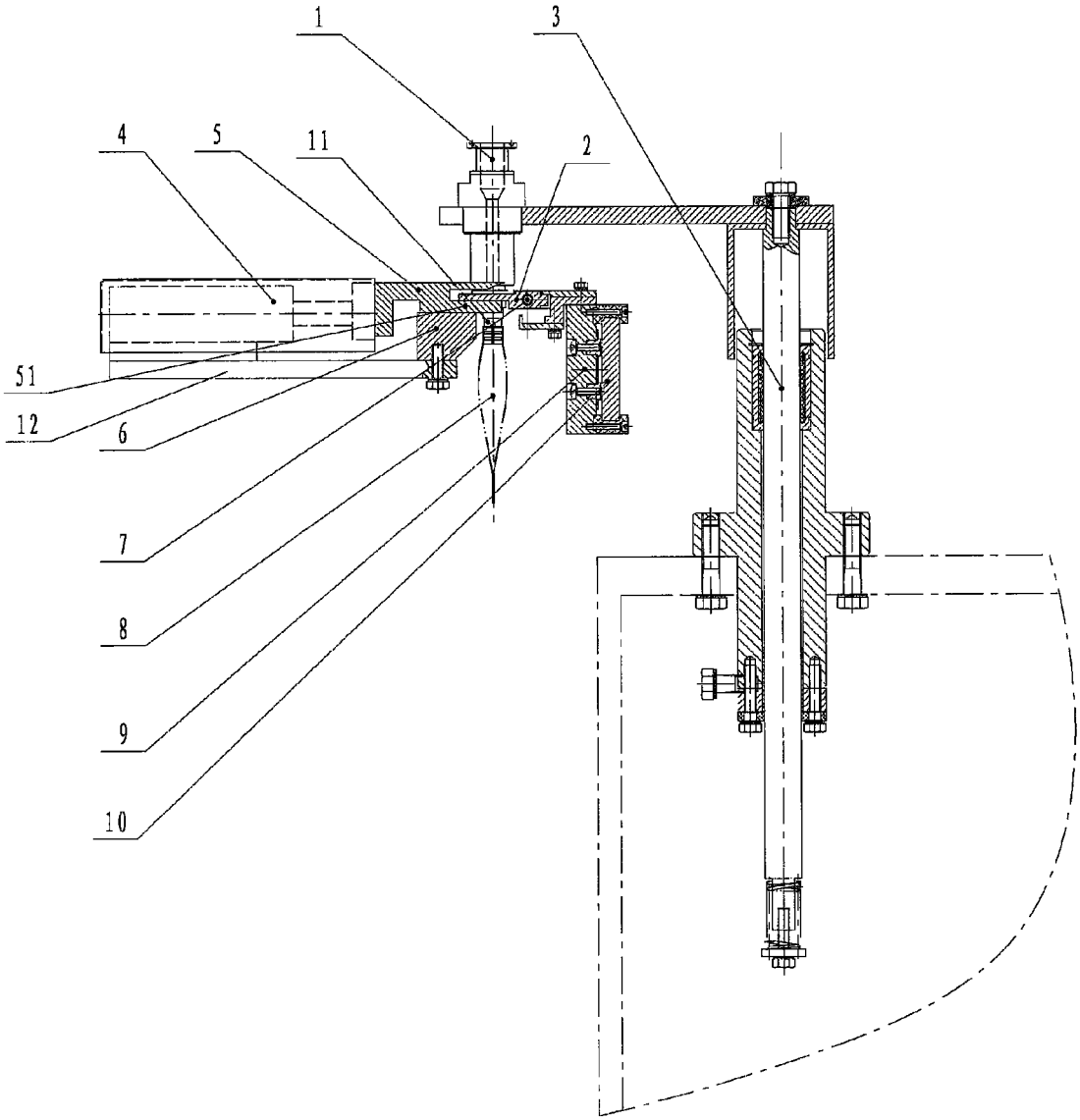
FIG. 1 is an illustration of a locating device under a filling condition according to a preferred embodiment of the present invention.
Figure 2:
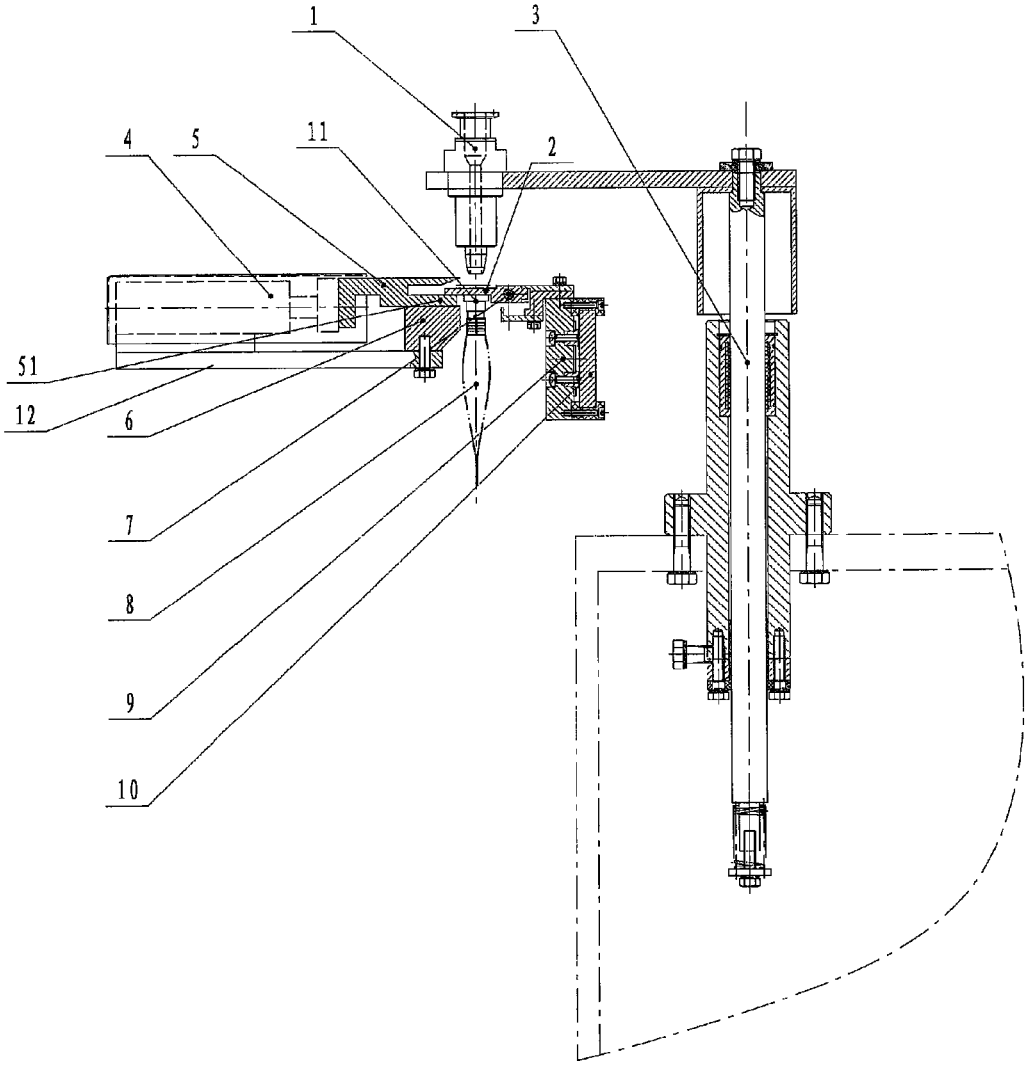
FIG. 2 is an illustration of a locating device under non-filling condition according to the above preferred embodiment of the present invention.

Referring to FIGS. 1 and 2 of the drawings, a large and soft infusion bag production line includes a filling mouth lifting device 3, a filling mouth 1 mounted on the filling mouth lifting device 3 in such a manner that a lifting action is driven by the filling mouth lifting device 3, a soft bag connecting clip sliding plate 10, a soft bag connecting clip base 9 provided on the soft bag connecting clip sliding plate 10, a soft bag connecting clip 2 mounted on the soft bag connecting clip base 9 in such a manner that the soft bag connecting clip 2 is guided to move by the soft bag connecting clip base 9 through the soft bag connecting clip sliding plate 10, a turning pin 7 connecting between the soft bag connecting clip 2 and the soft bag connecting clip base 9 such that the soft bag connecting clip is capable of having a 90° C. turning movement surrounding the turning pin 7, so as to ensure that the soft bag connecting clip 2 is maintained at a vertical position during soft bag manufacture process and is positioned at a horizontal position during filling process. According to the preferred embodiment of the present invention, the positioning device for a production line of a large and soft infusion bag includes a driving cylinder 4, and a positioning fork 5 having a first and a second ends and a soft bag connecting clip 2, wherein the driving cylinder 4 has a retractable end connected to the first end of the positioning fork 5, wherein the second end of the positioning fork 5 is positioned between the connecting clip 2 and a filling mouth 1 of the infusion bag, wherein the positioning fork 5 has a lower portion and comprises a stress plate 51 at the lower portion of the positioning fork 5, wherein the stress plate 51 is positioned below the connecting clip 2. In particular, an upper surface of the stress plate 51 is fittingly connected to a bottom surface of the connecting clip 2. According to the preferred embodiment of the present invention as illustrated in the drawings, the stress plate 51 and the positioning fork 5 are integrally connected and are capable of simultaneous movement driven by the driving cylinder 4. In addition, the a bottom of the stress plate 51 is mounted onto a frame body 12 of the production line through a support element 6, therefore a upper surface of the stress plate 51 is fittingly connected to a bottom surface of the connecting clip 2, and a bottom surface of the stress plate 51 is fittingly connected to an upper surface of the support element 6.

During filling process, the driving cylinder 4 drives the positioning fork 5 to move to the right side, the stress plate 51 on the positioning fork 5 is positioned at a bottom end of the soft bag connecting clip 2 and the right distal end of the stress plate 51 is moved beyond a central axis of the soft bag connecting element 11. Then the filling mouth lifting device 3 drives the filling mouth 1 to have a downward movement. The filling mouth 1 is in direct contact with the soft bag connecting element 11 and the filling mouth 1 exerts a predetermined level of force onto the soft bag connecting element 11 so as to ensure that the connection between the filling mouth 1 and the soft bag connecting element 11 is securely sealed. Because the upper surface of the stress plate 51 is fittingly connected to the bottom surface of the connecting clip 2 while the right distal end of the stress plate 51 is positioned beyond the central axis of the soft bag connecting element 11, the pressure on the connecting clip 2 from the soft bag connecting element 11 is transmitted to the support element 6. Accordingly, the force exerted on the turning pin 7 is eliminated or greatly reduced, the turning pin is protected and the lifespan of the turning pin is prolonged.

One skilled in the art will understand that the embodiment of the present invention as shown in the drawings and described above is exemplary only and not intended to be limiting. It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims. For example, the stress plate 51 and the positioning fork 5 are constructed into two separate elements and is connected by a connecting element, the stress plate 51 and the positioning fork 5 are driven by two different and separate driving elements, or a gap is provided between the stress plate 51 and the soft bag connecting clip 2, and the stress plate 51 and the support element 6, etc. These modifications are encompassed within the spirit and scope of the present invention.

What is claimed is:

1. A positioning device for a production line of a large and soft infusion bag which includes a driving cylinder (4), a positioning fork (5) having a first and a second ends and a soft bag connecting clip (2), wherein the driving cylinder (4) has a retractable end connected to the first end of the positioning fork (5), wherein the second end of the positioning fork (5) is positioned between the connecting clip (2) and a filling mouth (1) of the infusion bag, the position device characterized in that: the positioning fork (5) has a lower portion and comprises a stress plate (51) at the lower portion of the positioning fork (5), wherein said stress plate (51) is positioned below the connecting clip (2).

2. The positioning device for a production line of a large and soft infusion bag, as recited in claim 1, wherein said stress plate (51) and said positioning fork (5) are integrally connected.

3. The positioning device for a production line of a large and soft infusion bag, as recited in claim 2, wherein a bottom of said stress plate (51) is mounted onto a frame body (12) of the production line through a support element (6).

4. The positioning device for a production line of a large and soft infusion bag, as recited in claim 3, wherein a upper surface of said stress plate (51) is fittingly connected to a bottom surface of said connecting clip (2), and a bottom surface of said stress plate (51) is fittingly connected to an upper surface of said support element (6).

5. The positioning device for a production line of a large and soft infusion bag, as recited in claim 2, wherein an upper surface of said stress plate (51) is fittingly connected to a bottom surface of said connecting clip (2).

6. The positioning device for a production line of a large and soft infusion bag, as recited in claim 1, wherein a bottom of said stress plate (51) is mounted onto a frame body (12) of the production line through a support element (6).

7. The positioning device for a production line of a large and soft infusion bag, as recited in claim 6, wherein a upper surface of said stress plate (51) is fittingly connected to a bottom surface of said connecting clip (2), and a bottom surface of said stress plate (51) is fittingly connected to an upper surface of said support element (6).

8. The positioning device for a production line of a large and soft infusion bag, as recited in claim 1, wherein an upper surface of said stress plate (51) is fittingly connected to a bottom surface of said connecting clip (2).

* * * * *